US009132683B2

(12) United States Patent
Zehetner et al.

(10) Patent No.: US 9,132,683 B2
(45) **Date of Patent: *Sep. 15, 2015**

(54) HAND STAMP

(71) Applicant: Trodat GmbH, Wels (AT)

(72) Inventors: Markus Zehetner, Leonding (AT); Manfred Ortner, Pennewang (AT); Christian Rupp, Zeltweg (AT)

(73) Assignee: Trodat GmbH (AT)

( * ) Notice: Subject to any disclaimer, the term of this patent is extended or adjusted under 35 U.S.C. 154(b) by 0 days.

This patent is subject to a terminal disclaimer.

(21) Appl. No.: 13/893,686

(22) Filed: May 14, 2013

(65) Prior Publication Data

US 2013/0312627 A1 Nov. 28, 2013

(30) Foreign Application Priority Data

May 15, 2012 (AT) ..... A 584/2012

(51) Int. Cl.

| | |
|---|---|
| ***B41K 1/38*** | (2006.01) |
| ***B41K 1/54*** | (2006.01) |
| ***B41K 1/50*** | (2006.01) |
| ***B41K 1/52*** | (2006.01) |

(52) U.S. Cl.
CPC ... *B41K 1/38* (2013.01); *B41K 1/50* (2013.01); *B41K 1/52* (2013.01); *B41K 1/54* (2013.01)

(58) Field of Classification Search
CPC ..... B41K 1/38; B41K 1/50; B41K 1/52; B41K 1/54; B41K 1/02
USPC ..... 101/333, 327, 405, 406, 103, 109
IPC ..... B41K 1/38, 1/54, 1/50
See application file for complete search history.

(56) References Cited

U.S. PATENT DOCUMENTS

| | | | | |
|---|---|---|---|---|
| 827,347 | A * | 7/1906 | Campbell | 101/334 |
| 859,310 | A * | 7/1907 | Matthews | 101/334 |
| 4,676,162 | A | 6/1987 | Phipps, Sr. et al. | |
| 5,510,820 | A * | 4/1996 | Aulick et al. | 347/85 |
| 5,974,969 | A | 11/1999 | Okumura et al. | |
| 6,189,450 | B1 * | 2/2001 | Shih | 101/327 |
| 6,834,584 | B1 * | 12/2004 | MacNeil | 101/333 |
| 6,968,781 | B1 | 11/2005 | Petersen | |
| 7,096,785 | B2 * | 8/2006 | Petersen | 101/333 |
| 8,408,125 | B2 | 4/2013 | Feilecker et al. | |

(Continued)

FOREIGN PATENT DOCUMENTS

| | | | |
|---|---|---|---|
| AT | 001129 | U1 | 11/1996 |
| AT | 503112 | B1 | 8/2007 |
| JP | 10181174 | A * | 7/1998 |

(Continued)

*Primary Examiner* — Leslie J Evanisko
(74) *Attorney, Agent, or Firm* — Lerner, David, Littenberg, Krumholz & Mentlik, LLP

(57) ABSTRACT

A stamp includes a printing unit and an actuator unit connected thereto by a connecting element. A printing plate is arranged in or on the printing unit to be moved from a neutral position into a printing position against a resetting force. The printing unit is arranged within a housing, including a support element having a pan bottom and at least one contiguous lateral wall stabilizing an ink storage body for receiving stamp ink. The printing plate is arranged abutting against the ink storage body for accepting stamp ink. The support element includes at least one sealable liquid-tight opening in the pan bottom that can be used to connect the support element to the actuator unit of the stamp and/or which can serve as a refill opening for stamp ink.

13 Claims, 11 Drawing Sheets

(56) References Cited

U.S. PATENT DOCUMENTS

| | | | | |
|---|---|---|---|---|
| 2005/0061175 | A1 | 3/2005 | Sculler | |
| 2009/0101032 | A1 * | 4/2009 | Slane et al. | 101/333 |
| 2012/0006214 | A1 * | 1/2012 | Feilecker et al. | 101/333 |

FOREIGN PATENT DOCUMENTS

| | | | |
|---|---|---|---|
| JP | 2003305932 | A * | 10/2003 |
| JP | 2007152748 | A | 6/2007 |
| WO | 2007082330 | A1 | 7/2007 |

* cited by examiner

Fig.4
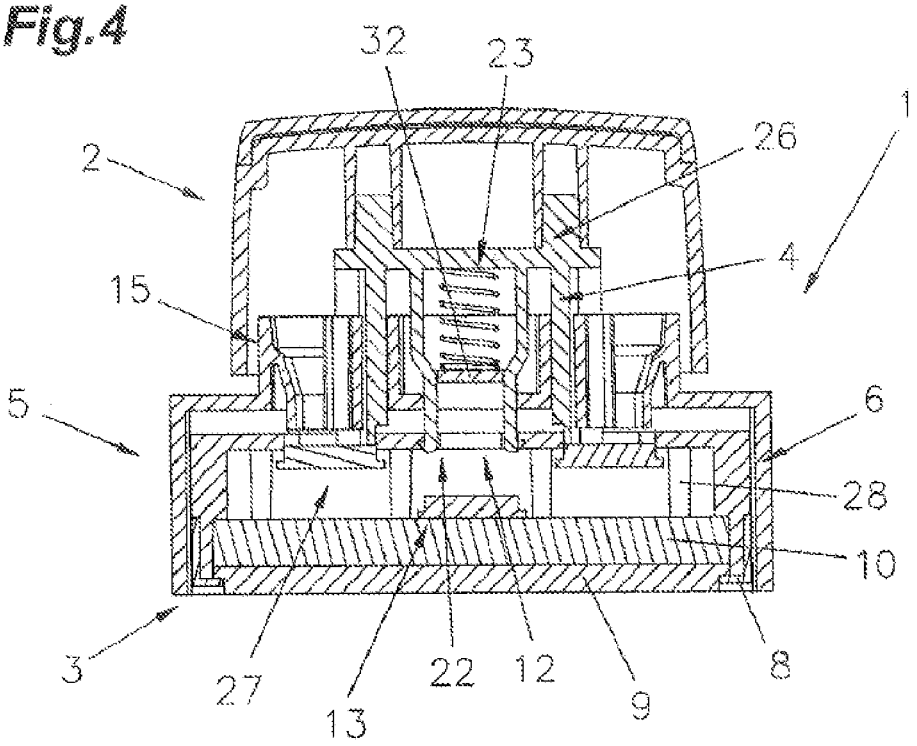
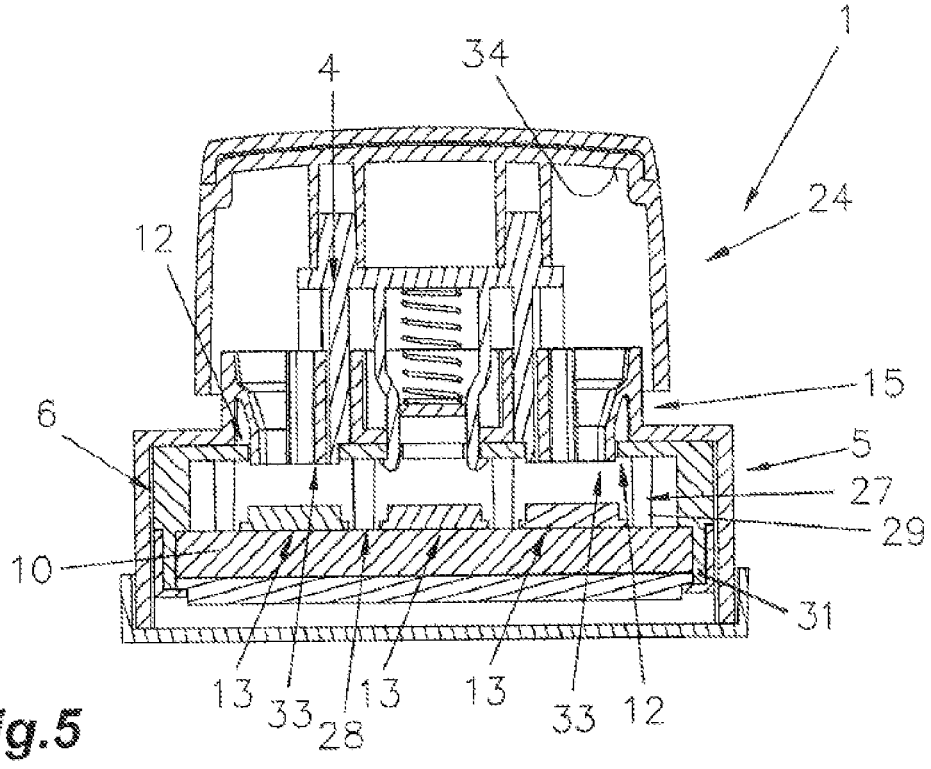
Fig.5

Fig.13
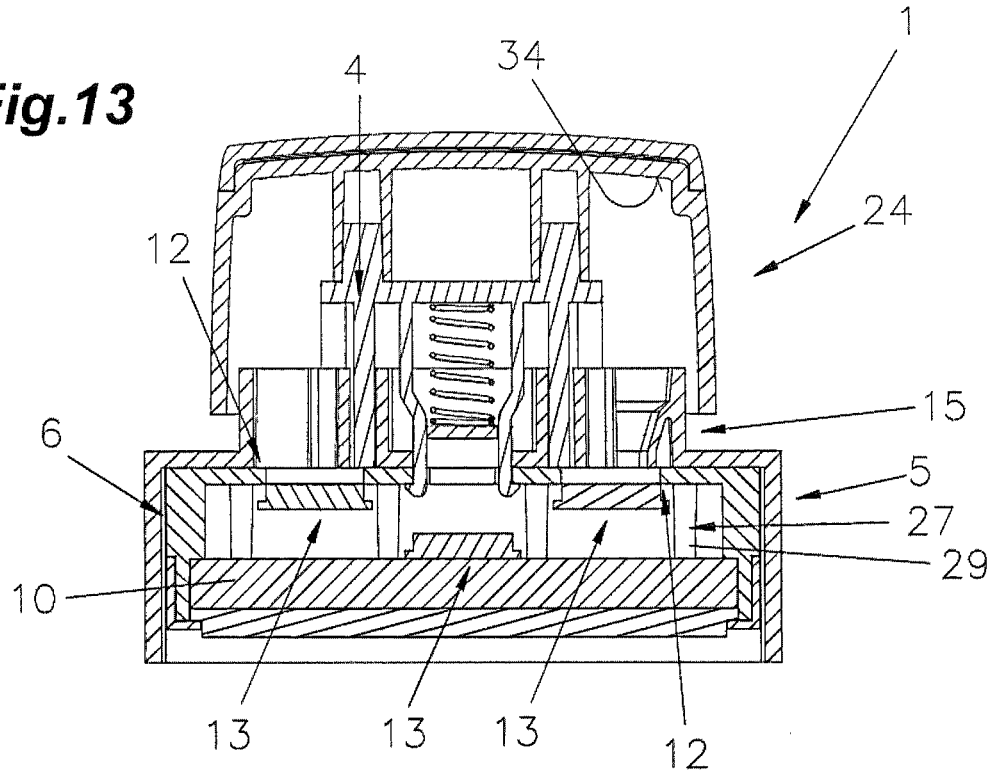
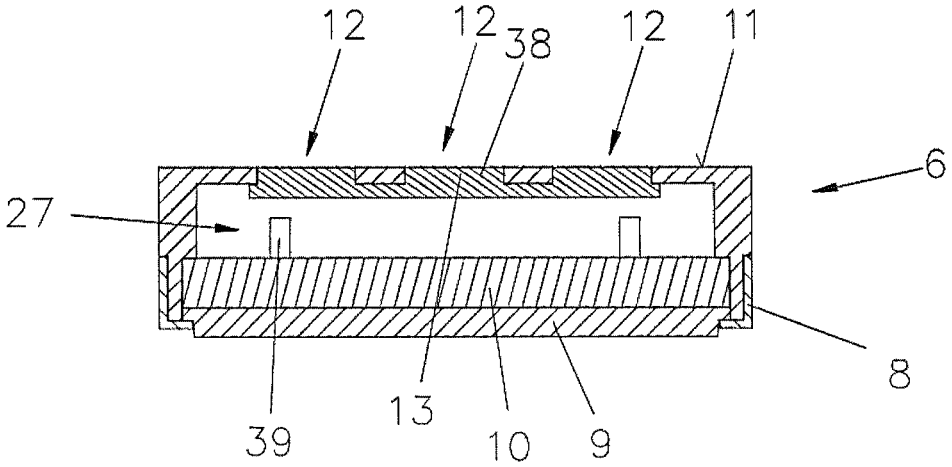
Fig.12

*Fig.16*
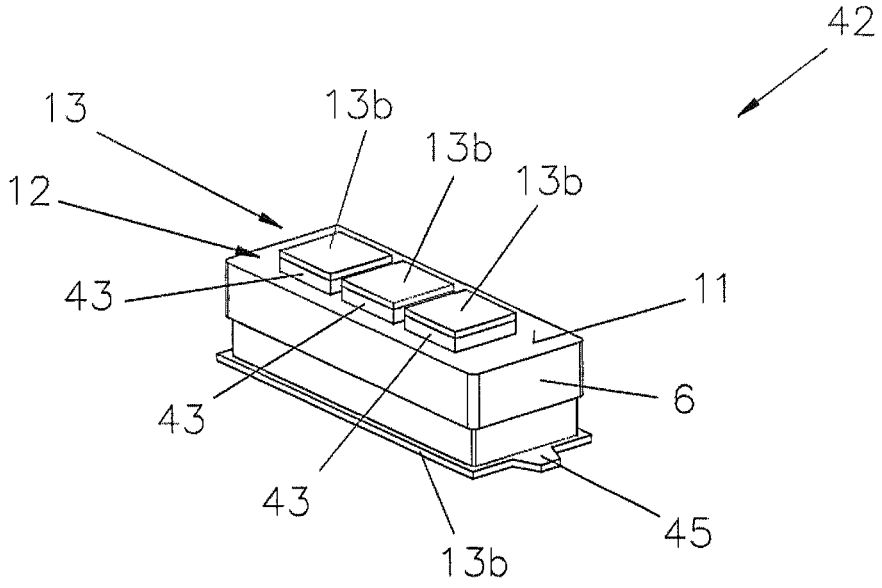
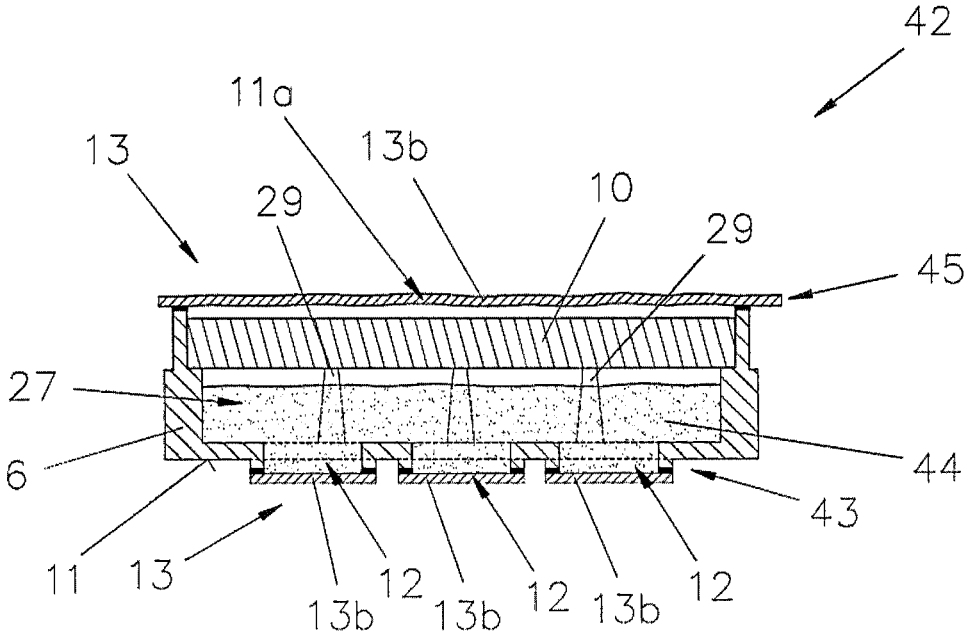
*Fig.17*

HAND STAMP

CROSS-REFERENCE TO RELATED APPLICATIONS

The present application claims priority from Austrian Application No. A 584/2012, filed May 15, 2012, the disclosure of which is incorporated herein by reference.

BACKGROUND OF THE INVENTION

The invention relates to a printing unit for a stamp, with a housing that accommodates a pan-shaped support element featuring a pan bottom and at least one lateral wall arranged contiguous thereto, with the support element holding an ink storage body for accepting stamp ink, a printing plate abutting against the ink storage body and at least the pan bottom formed to be liquid-tight. The invention further relates to a stamp with a printing unit and an actuator unit connected thereto by means of a connecting element, wherein a printing plate is arranged in or on the printing unit and moveable against a resetting force from a neutral setting into a print setting by means of the actuator unit. The invention further relates to a semi-finished product to be arranged in a stamp comprising a pan-shaped support element formed with an open top side opposite the pan bottom for insertion of an ink storage body. The invention further relates to a stamp cartridge to be arranged in a stamp for initial filling or refilling with ink comprising a pan-shaped support element featuring a pan bottom and at least one lateral wall and an open top side formed opposite the pan bottom for insertion of an ink storage body. The invention also relates to a method for saturating an ink storage body of a stamp with stamp ink, according to which stamp ink is filled into a pan-shaped support element for the ink storage body featuring a pan bottom and at least one lateral wall contiguous thereto. However, the invention also relates to a support element comprising a pan bottom and at least one lateral wall contiguous thereto.

One disadvantage of existing stamps referred to as "pre-ink-stamps" or similarly is clean, metered introduction of ink into the ink storage body or printing plate as such.

The Term

"pre-ink-stamps" refers to stamp solutions also known as presaturated and/or prefabricated stamps. Another disadvantage is that the period of saturation of the systems, meaning the time between addition of the ink and first possible imprint is very long. There are already related product solutions and descriptions of industrial property rights, such as U.S. Pat. No. 6,968,781 B1, according to which stamp ink is added to a type of pan. The disadvantage of this solution is a lack of metering accuracy because an uncontrolled saturation process starts immediately. WO 2007/082330 describes how this ink storage body clicks into the stamping device and can be folded out again for filling, but this solution also does not allow for exact and metered filling without aids.

In U.S. Pat. No. 5,974,969 A, U.S. Pat. No. 4,676,162 A, JP 2007-152748 or US 2005/0061175 A similar systems are described as well.

AT 001 129 U discloses a stamp with a printing unit comprising a pan-shaped support element, an ink storage body saturated with stamp ink and a printing plate, with the pan bottom formed to be liquid-tight.

AT 503 112 B1 describes a stamp including a partially porous printing plate that can be moved by means of an actuator unit out of a neutral setting pulled back into a housing against a spring force into a print setting. The printing plate abuts against an ink storage body mounted in a support element at least partially surrounding the ink storage body for the purpose of receiving stamp ink. This support element is formed in the shape of a pan and features a connecting element snapped onto an actuator unit, with said connecting element featuring at least one filler tube aligned with an ink refill opening in the bottom wall of the support element.

BRIEF SUMMARY OF THE INVENTION

It is the object of the invention to provide a stamp and replacement parts facilitating improved handling. Another object of the invention is to reduce the saturation time of the ink storage body and/or accelerate the process of refilling.

This object of the invention is solved independently by each of the units indicated above, the printing unit, the support element of which features at least one opening used to connect the support element with an actuator unit of the stamp and/or serves as a refill opening for stamp ink, with a sealing element arranged in and/or on the opening to provide a liquid-tight seal, a stamp wherein the printing unit is developed according to the embodiments of the disclosure, the semi-finished product with at least one opening arranged in the pan bottom, said opening being sealed liquid-tight with a sealing element, the stamp cartridge, with at least one opening arranged in the pan bottom, said opening as well as the top side sealed liquid-tight by means of a sealing element, in particular a foil and stamp ink contained or arranged in the support element and the ink storage body, and by way of the method for saturating the ink storage body of a stamp whereby a predefinable volume of stamp ink is filled into the support element, then the ink storage body is inserted along with a printing plate abutting against said ink storage body, whereupon the support element is rotated (180°) so that the printing plate is facing downward and the actuator unit is connected to the support element, or, upon insertion of the ink storage body, the open top side is sealed by means of a sealing element, in particular a foil.

This invention therefore facilitates filling the pan-shaped support element up to a predefined level with stamp ink so that the ink storage body can be inserted while still dry without the requirement that the stamp be completely assembled or built beforehand. As a consequence, the ability for clean assembly of the individual stamp components is provided. Furthermore, filling the support element is easier because this step is taken during stamp assembly rather than having to fill the stamp by means of the filler opening after the stamp has been assembled. Therefore, automatic production of the stamp, in particular automatic filling, is possible because saturation times do not have to be taken into consideration. The method also improves the saturation process of the ink storage body, specifically because some of the stamp ink is not absorbed by the ink storage body while filling the stamp but only after it has been filled completely. This allows for more accurate metering of stamp ink. The filling process is accelerated as well because there is sufficient space to accommodate the ink, which only has to be filled into the support element without the need to monitor whether the ink has been absorbed so that additional ink can be added.

It is also an advantage that the formation of the opening provides an easy option for connecting actuator unit and support element and/or an easy option for resaturating the stamp, with the filling process optimized due to the liquid-tight seal on the opening by the sealing element. This invention also renders removal of the sealing element during stamp assembly unnecessary because it is deformed or pierced as the components are assembled. As a result, no further steps are required in the procedure.

It is a significant advantage that in the case of the stamp cartridge a certain ink volume and ink storage body are contained in the support element, allowing the ink storage body to absorb the ink once a liquid-tight seal has been created on the top side. This means the ink is absorbed by the ink storage body while the stamp cartridge is stored. Therefore, the stamp cartridge is completely saturated with ink at the time it is used and the user is able to generate a stamp imprint immediately upon installation into the stamp. Thus it is also easy to fill the support element with various volumes of ink adapted for the different materials of the ink storage body. As a result, the ink volume can be adjusted accurately.

A formation wherein the sealing element is formed of foil and preferably attached to the support element by way method known as "glass lidding" is advantageous in that it allows for liquid-tight sealing of the openings and top side. Thus, storage time is increased significantly.

Several openings may also be provided in the support element, with the openings sealed by means of one single or several sealing elements. One of the results is a simplification of the of the printing unit assembly. On the other hand it is also possible that by punching out the sealing element of one opening the sealing elements of the other openings are pushed out, at least partially, at the same time. It is, of course, possible for individual openings to be sealed liquid-tight individually, allowing for these sealing elements to be destroyed or pierced independently of each other.

For this process it is advantageous for ribs to be arranged on an interior surface of the support element or ink storage body and to abut against the sealing element or can be brought into contact with it, thereby avoiding tilting of this shared sealing element by pushing it out of only one opening. As a result, the process safety of at least partially pushing out all sealing elements from the opening or several connected sealing elements is improved.

However, provision can also be made for a foil formed from a sealing foil and the support element formed from a thermoplastic container or material so that the foil can be thermally attached to the support element by a method known as "glass lidding". The result is a very long liquid-tight storage period.

The housing wherein the support element for the ink storage body is arranged can feature at least one projection pointing toward the support element. This projection can be brought to engage with the opening or openings, thereby allowing for the sealing element(s) to be removed or pierced upon the first actuation stroke of the actuator unit. Thus, it allows for a constructive and simple solution for the printing unit.

In order to simplify this removal or at least partial removal or piercing of the sealing element, the projection may feature a cutting or punching element in its end region facing the support element.

To simplify the filling process, in particular of filling the support element with a predefined volume of stamp ink, it is advantageous to arrange at least one indicator element on the interior surface of the support element for indicating at least the maximum fill level for stamp ink. At the same time, this indicator element can also serve as a segmental body for the ink storage body, ensuring that upon insertion this ink storage body does not come in contact with ink immediately but is positioned on top of the indicator elements. This means that upon production or filling, first the ink is added, then the ink storage body is inserted on top of the indicator elements without coming in contact with the ink added and the support element is rotated to saturate the ink storage body. Thus the ink storage body can absorb the ink completely during storage.

A version of the stamp's embodiment provides that the connecting element linking the actuator unit with the printing unit protrude at least partially into an opening of the support element, thereby causing the connecting element to push out or pierce at least one of the sealing elements of the support element.

As an alternative and/or in addition to the aforementioned projection on the housing, it is possible for the actuator unit to feature at least one projection pointing towards the support element of the printing unit. This projection can be brought to engage with the opening(s). In one version of the embodiment thereto the projection may feature a cutting or punching element in its end region facing the support element. In another version of the embodiment the projection may be developed at least approximately in the shape of a pipe or funnel. This provides the same advantages as stated above.

The housing of the printing unit may feature at least one refill opening arranged separately from a guiding device for the actuator unit projection, of which there is at least one. This spatial separation of actuator unit guide and the opening for refilling stamp ink serves to avoid clogging the guiding device with stamp ink, thereby improving stamp operation.

The connecting element may also feature at least one filler tube for stamp ink, thereby simplifying filling, i.e. refilling of the stamp with stamp ink, in particular because only part of the actuator unit has to be removed.

The connecting element may feature at least one catch post used to connect the actuator unit with the printing unit, thereby simplifying assembly.

However, the connecting element may also feature at least two catch posts used to connect the actuator unit with the printing unit. These catch posts are positioned so that the gap formed between them narrows towards support element. On the one hand, this allows for an easy connection of the actuator unit with the printing unit. On the other it also provides an option to easily separate the components, allowing for the support element to be replaced in its entirety or for refilling with stamp ink analogous to the initial filling.

At the same time, it is possible that catch the post(s) feature(s) at least three sections, two of which traverse at least approximately vertically (in relation to the stamp's printing setting) and a section in between is formed to traverse at an angle. Thus separation of the actuator unit from the printing unit is simplified.

Another formation where at least one opening sealed liquid-tight with a sealing element is arranged in the pan bottom is also advantageous because it facilitates direct filling with ink. This type of semi-finished product provides another advantage in that it can simply be mounted in a stamp after being filled without the need to open the sealed openings beforehand. This takes place simply by means of a stamping process during which the sealing element is pierced or pushed from the openings.

A formation with the stamp ink contained in the support element sealed liquid-tight by means of a sealing element is advantageous, because as a result the correct ink volume for the respective stamp is already filled in at the time the semi-finished product is delivered. This means upon insertion of the ink storage body it will absorb the ink supplied therein completely.

A formation where an ink storage body can be inserted into the support element is advantageous in that the user is able to carry out the first stamping procedure as quickly as possible.

Another advantageous development is one wherein the support element, in particular an interior space or prechamber is divided into two areas, with the first area formed to accept the ink and the second area for accepting the ink storage body, because it allows for separate filling and thereby significantly accelerating the speed of production since there is no need to consider saturation times.

The object is also solved by means of a stamp cartridge wherein at least one opening is arranged on the pan bottom, with the opening and the open top side sealed liquid-tight by means of a sealing element, in particular a foil, and stamp ink and ink storage body contained in or arranged in the support element. The advantage here is that saturation of the ink storage body already starts after production although the stamp cartridge is not mounted into a stamp. Thus the ink storage body can absorb the ink completely during the time in storage. An additional advantage lies in the long storage period without the ink storage body drying out facilitated by sealing the support element. Production cost and production time are therefore reduced as well. An additional significant advantage is that a certain amount of excess ink can be poured in so that there is still liquid ink in the interior of the support element once the ink storage body has been saturated completely with ink. This ink can be absorbed by the printing plate during assembly of a stamp.

Beyond that, it is also possible to omit the ink storage body when using a stamp cartridge and to add only ink, i.e. that the stamp cartridge is delivered containing a certain volume of ink and with openings and top side sealed liquid-tight by means of a foil. Therefore, the manufacturer or user of stamps is now able to remove the foil from the top side and insert an ink storage body suitable for his purposes but with the volume of ink required for this stamp already filled into this stamp.

It is advantageous when the foil is formed of aluminum with a coating for thermal attachment, in particular aluminum foil with thermal coating or sealing foil, and the foil is attached to the support element according to the "glass lidding" method for the purpose of liquid-tight sealing of top side and/or openings because it allows for a very long period of storage without any ink leakage.

Another formation wherein the foil for insertion into the stamp is pierceable at the openings is also advantageous, because the user does not have to remove it and thus rapid mounting is facilitated.

The fact that the foil on the topside of the support element is arranged so it can be peeled off or removed is also an advantage, because it allows for easy removal of the foil without leaving behind remaining foil pieces stuck to the support element.

However, the object of the invention is also solved by means of a support element, the interior space of which, in particular a prechamber, is divided into two areas, with the first area formed to accept ink and the second area to accept the ink storage body. The advantage with this arrangement is the ability for separate filling, i.e. first a specific ink volume is added and then the absorbent ink storage body is inserted in the area above.

It is also advantageous when indicator elements, in particular pins, are arranged in the prechamber because they provide the opportunity for easily checking the volume of ink added or adding the volume of ink corresponding to the elevation of the indicator elements.

With respect to the method for saturating an ink storage body of a stamp with stamp ink, the above described advantages are applicable. At the same time, additional advantages listed in the description may be used.

One preferred method for saturating an ink storage body of a stamp with stamp ink comprises filling stamp ink into a pan-shaped support element for ink storage body. The support element featuring a pan bottom and at least one lateral wall contiguous thereto. A predefinable volume of stamp ink is filled into support element, then the ink storage body and a printing plate abutting thereto are inserted. The support element is then rotated so that the printing plate is faced downward and an actuator unit is connected to the support element. After the ink storage body has been inserted, the open top side may be sealed by means of a sealing element such as a foil element.

The sealing element may be at least partially removed simultaneously with and as a result of connecting actuator unit with support element. Prior to removal, the sealing element may be attached to support element by way of a method known as "glass lidding".

Finally, please note that all features and advantages listed in the description can be added to the features and advantages mentioned before.

For a better understanding of the invention, it is explained in more detail by means of the following figures.

BRIEF DESCRIPTION OF THE DRAWINGS

Each of the following is a highly simplified schematic showing:

FIG. 4 Cross section of stamp after joining together printing unit and actuator unit;

FIG. 5 Stamp according to FIG. 4 after the first actuation stroke of the actuator unit;

FIG. 12 Cross section of ink storage body support element with a version of the embodiment of the sealing element;

FIG. 13 Version of the embodiment of the stamp;

FIG. 16 Perspective view of a stamp cartridge;

FIG. 17 Simplified cross-sectional schematic of the stamp cartridge.

DETAILED DESCRIPTION

To begin with, it should be noted that the same parts are assigned the same reference signs or the same component designations in the differently described embodiments, with the ability to use the disclosures included in the entire description analogously for the same parts with the same reference signs. The descriptions of the selected position specifications, such as above, below, lateral, etc., are also directly related to the figure described and illustrated and must be applied analogously to the new position.

Figure 1:
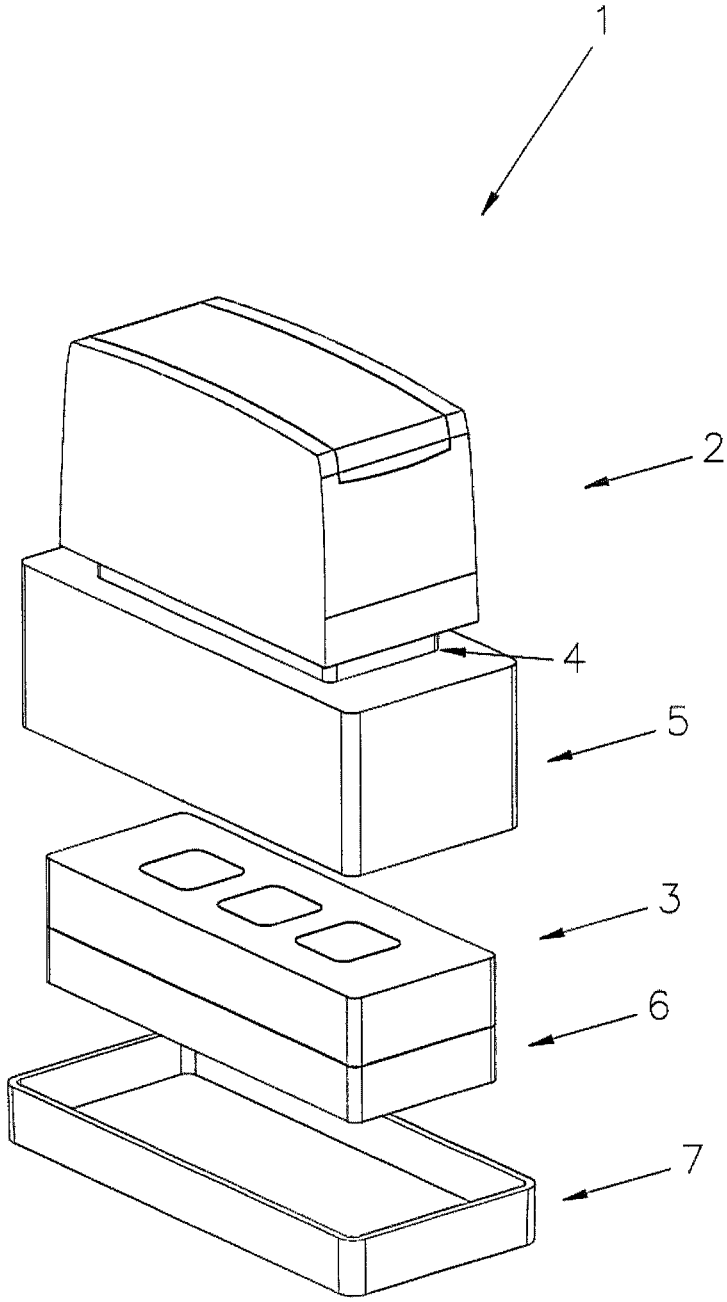
FIG. 1 Perspective view of a stamp according to the invention.

FIG. 1 depicts an exploded view of stamp 1. Roughly structured, this stamp 1 comprises an actuator unit 2 responsible for the stroking motion of stamp 1 and therefore triggering the imprint, and a printing unit 3 connected to the actuator unit 2 by means of a connecting element 4 featuring a housing 5, a support element 6 at least partially arranged inside housing 5 and a covering cap 7. For one, covering cap 7 is intended to prevent stamp 1 from drying out and for another to protect from unintended coloration when no imprint is made.

Figure 2:
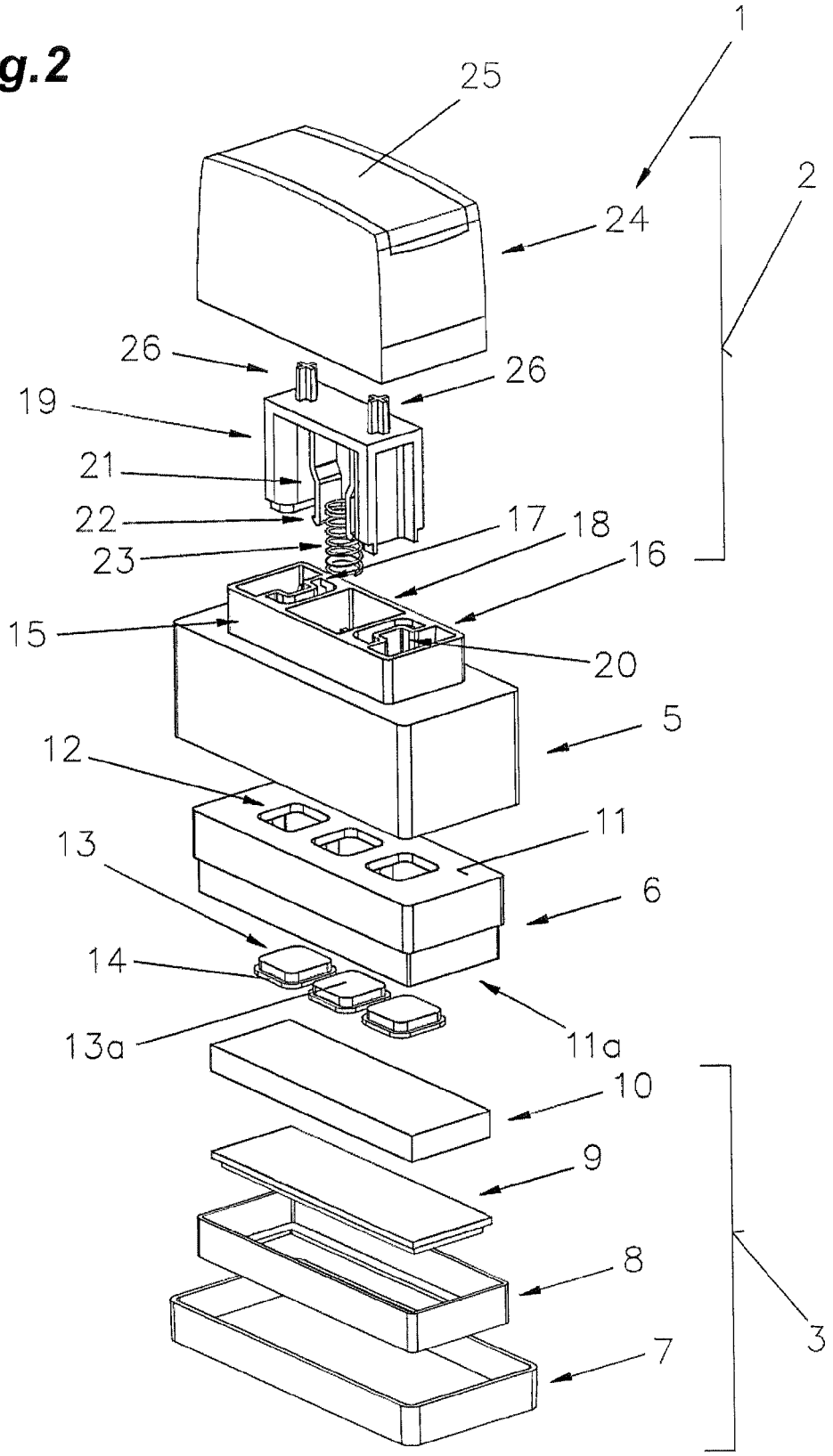
FIG. 2 Exploded view of the embodiment of the stamp.

As shown more clearly in FIG. 2, in addition to housing 5, support element 6 and covering cap 7, printing unit 3 features a retaining frame 8, a printing plate 9 and an ink storage body 10. In its assembled state, the printing plate 9 is seated on the ink storage body 10. Ink storage body 10 is at least partially encased by the support element 6; printing plate 9 and ink storage body 10 are secured by the retaining frame 8 on or in support element 6.

Support element 6 arranged in housing 5 is formed in the shape of a pan, with a pan bottom 11 facing actuator unit 2 and the open top side 11*a* facing the contact area of stamp 1 in the assembled state of stamp 1. This version of the embodiment provides for three openings 12 in pan bottom 11, wherein the center opening 12 serves to connect printing unit 3 with actuator unit 2 by means of connecting element 4. Both openings 12 located near the edges are intended for refilling stamp 1, as will be explained in more detail below. Within the context of this invention it is possible to provide fewer or more openings 12 in pan bottom 11 or support element 6, e.g., only one if refilling of stamp 1 is not required, but also two, four, five, six, etc., openings 12. It is also possible, of course, that only one of the openings 12 can be used for refilling if printing unit 3 features a filling duct emptying into the sole opening 12. In that case, the process of filling may involve removal of handle piece 24 to facilitate filling ink into the filling duct of printing unit 3 and thereby into support element 6.

According to the invention, these openings 12 are sealed liquid-tight by means of a sealing element 13 at least during initial filling of stamp 1. The present version of the embodiment provides for three sealing elements 13, i.e. one each per opening 12. These sealing elements 13 produce a liquid-tight seal for openings 12 but are at least partially removable, as will be explained in more detail in the following. As illustrated in FIG. 2, sealing elements 13, for example, are developed in the form of stopper 13*a*, wherein these stopper-shaped sealing elements 13 or stoppers 13*a* are inserted into openings 12 from below, that is from inside to outside relative to the pan-shaped support element, and connected with support element 6. For this purpose, stopper 13*a* may feature a circumferential edge 14 attached to pan bottom 11 on the inside of support element 6 or glued to support element 6, thereby ensuring a reliable seal. Sealing elements 13 or stopper 13*a* may also be pressed into openings 12. It is, of course, also possible for stopper 13*a* to be pushed or pressed onto openings 12, thereby allowing for their removal before assembly of stamp 1 but after it has been filled. The advantage here is that stoppers 13*a* can be removed completely and do not have to remain in support element 6, as is the case when they are positioned from the inside.

However, the preferred method of closing and sealing opening 12 in pan bottom 11 is by means of foil 13*b*, as shown in FIGS. 16 to 17. Foil 13*b* may either be pierced during assembly of stamp 1 or at least partially peeled off prior to its assembly. Foil 13*b* may be embodied as desired, as a single or multiple layer foil 13*b* formed of synthetic material and/or metal, e.g., aluminum, and may be affixed using prior art methods, for instance by gluing or fusing the foil to support element. Within the context of this invention, it is also possible to use self-adhesive embodiments of foil 13*b*. It is essential that foil 13*b* be attached so that it seals openings 12, i.e. it prevents ink from leaking out when opening 12 is closed.

However, since this type of stamp 1 consists largely of synthetic materials and support element 6 in particular is also made of synthetic material, there is also the option that sealing elements 13 are already intended in opening 12 of support element 6 and are extruded during the production process by way of what is known as the 2-K injection molding process (not depicted). Here, the materials of support element and sealing element 13 may be formed from different synthetic materials. It is also possible to produce sealing element 13 as an insert during the injection molding process, which is destroyed or pushed out during assembly.

Another option is to form sealing elements 13 as a spherical seal (not depicted) similar to the spherical seal of a fountain pen cartridge. If support element 6 is positioned on a level during the filling process, these spheres seal openings 12; upon rotating support element 6 for assembly of stamp 1, openings 12 are released because spheres are lowered or pushed out.

Housing 5 features a dome-like attachment 15 facing in the direction of actuator unit 2. Canal-like recesses 16 to 18 are formed in this dome-like attachment 15. In this version of the embodiment, recesses 16 and 17 serve as a guide for guiding element 19 of connecting element 4, with recesses 16 and 17 in this version of the embodiment featuring a guide groove 20 in one of lateral walls. This guide groove is created by the channels formed in this manner and guiding element 19 of support element 4 must be equipped with a guide rib 21 complementary to the guide groove. Recesses 16, 17 formed separately from recesses 18 in this version of the embodiment are used as refill openings for refilling stamp 1 with stamp ink. Finally, on the one hand recess 18 serves to accept catch posts 22 of the connecting element, with a spring arranged between catch posts 22, allowing for printing plate 9 arranged in printing unit 3 to be displaced from the neutral setting into the print setting against a resetting force so that an imprint can be generated and, after said imprint has been completed, for actuator unit 2 and therefore also printing plate 9 to return automatically into neutral setting when there is no longer any force exerted on stamp 2. Catch posts 22 feature snap-in noses in the area of recess 18, which engage below the edge of recess 18.

In addition to connecting element 4, actuator unit 2 also features a handle piece 24 that may feature a transparent cover 25 in a corresponding recess in handle piece 24. It is a known fact that the purpose of these types of covers 25 is to store a sample of the imprint generated by stamp 1. Handle piece 24 is pushed onto projections 26 of connecting element 4, for the purpose of which handle piece 24 features the appropriate ribs or connectors used to establish the connection with connecting element 4. The preferred way of refilling stamp 1 is to remove handle piece 24 so that the appropriate ducts or openings 12 for adding the ink are easily accessible.

Figure 3:
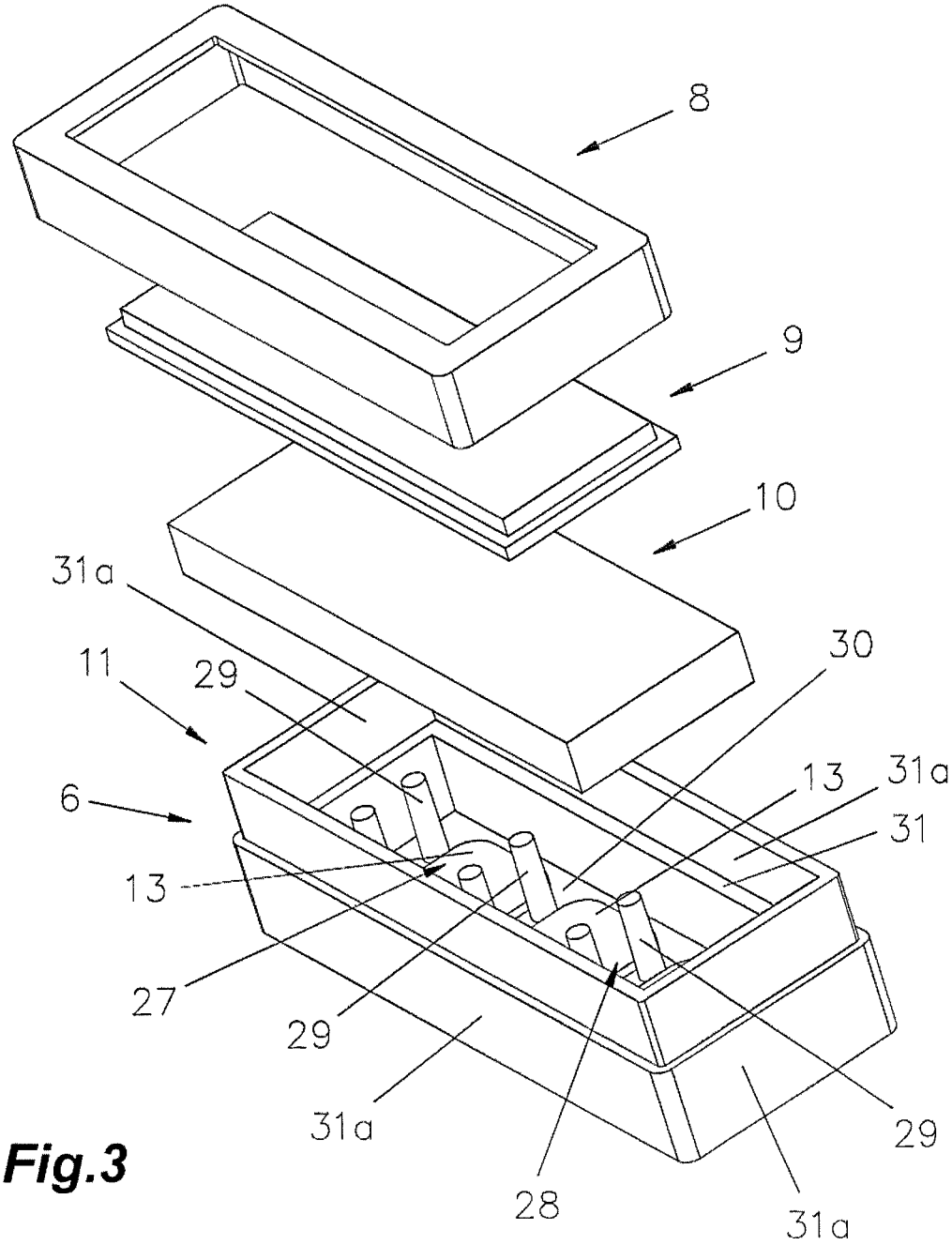
FIG. 3 Exploded view of the support element.

FIG. 3 shows a perspective of pan-shaped support element 6 in the inverted position (ink filling position), ink storage body 10, printing plate 9 and retaining frame 8 once more in an exploded view. Sealing elements 13 are inserted into support element 6 or openings 12 are sealed with sealing element 13.

This inverted position of support element 6 is the (initial) filling position according to the invention. In order to fill stamp 1, this pan-shaped support element 6 with openings 12 sealed liquid-tight by means of sealing elements is placed upside down onto a level area, i.e. onto pan bottom 11 so that a prechamber 27 or the interior space of support element 6 can be filled with stamp ink to the desired level or with the desired volume, i.e. that a certain volume of ink can be added to the interior space of support element 6 from above into the pan-shaped support element 6. This way, the filling procedure can be carried out very quickly because ink can flow into the interior space at different locations at the same time. To improve detection of the ink added, i.e. the desired level, especially while adding black stamp ink, for example, this prechamber 27 of support element 6 may be provided indicator elements 28 in the form of pins 29 arranged or formed on interior surface 30 of support element 6 and said pins indicate at least the maximum fill height of stamp ink. Here, indicator elements 28 can be formed in the shape of pins, cylinders, etc., protruding from interior surface 30 of pan bottom 11; a circumferential rib 31 can also be arranged in the lateral wall area 31*a* of support element 6. Where applicable, it is also possible that only one of these indicator elements 28, in particular pin 29 or rib 31, is provided or the number of pins 29 represented in FIG. 3 is not to be seen as limiting for the invention, respectively. These indicator elements 28, in particular pins 29 and circumferential rib 31 are preferably formed so as to serve as a bearing surface for ink storage body 10 as well. Ink is filled to pin height or up to the elevation of rib 31, with the fill volume being adjusted to the stamp ink capacity of ink storage body 10. The preferred ink level is slightly below the contact surface formed by pins 29 and rib 31, ensuring that upon insertion of elements, in particular ink storage body 10, there is no displacement of ink that may result in squirting or messy processes. It is therefore always possible to fill an exact, predefined ink volume into stamp 1 easily and quickly while producing, i.e. assembling stamp 1. Since stamp ink can be filled simply into the pan-shaped support element 6 without the absorbent elements present in prior art, the filling process is extremely quick because there is no need to wait until the stamp ink is absorbed, incorporated or drawn into an element. Thus, automatic filling and production are also possible.

Here it should be noted that, as known in the art, ink storage body 10 may consist of foam plastic or any fluid-absorbing material of at least partially porous structure for accepting the stamp ink.

The next step is to insert ink storage body 10 into support element 6, in particular prechamber 27, and place printing plate 9 on top of said ink storage body and finally to connect these components with retaining frame 8. The preferred way to form printing plate 9 is so include a seal against ink storage body 10 in the margin area as well, in particular by arranging a circumferential sealing edge so that no ink can escape laterally from ink storage body 10 after assembly and fixing in place by means of retaining frame 8. Since the fill height of ink is slightly below pins 29, there are no additional steps, such as waiting until the ink has been absorbed by ink storage body 10, as is the case in prior art; ink storage body 10 can be inserted, allowing for very quick and straightforward assembly. In this state, the system still is "inactive", i.e. the stamp ink still is not absorbed by ink storage body 10, thereby facilitating clean assembly of the parts. This is possible because ink storage body 10 is not immersed into stamp ink during insertion into pan-shaped support element 6 but is placed on top of indicator elements 28, the tops of which preferably line up above the fill level of the ink. As a result, the individual elements can be placed easily without squeezing ink out of support element 6.

Activation is accomplished by rotating the filled support element 6 holding ink storage body 10 and printing plate 9 180° as shown in FIG. 4, thereby causing the stamp ink to flow from prechamber 27 onto ink storage body 10 and being absorbed by the latter and subsequently being transferred to printing plate 9 for generating the imprint. The printing plate can be formed according to prior art. In doing so, the assembly of stamp 1 can be continued after inverting support element 6 because there is no need to wait until the ink has been absorbed by ink storage body 10.

The connection with actuator unit 2 by means of connecting element 4 is established by pushing actuator unit 2 over dome-like attachment 15 of housing 5 of printing unit 3 and executing an initial actuation stroke of actuator unit 2 in the direction of printing unit 3. In the course of this actuation stroke, catch posts 22 push center sealing element 13 out of center opening 12 of support element 6 or destroy or remove foil 13*b*. As a result, the opening is unblocked and both catch posts 22 of connection element 4 are able to engage with or snap into support element 6 by way of opening 12, thereby establishing the connection.

As shown in FIG. 4, spring 23 is propped up by supporting element 32 arranged between catch posts 22, thereby causing the spring to be compressed during the actuation stroke and to return to neutral setting as a result of relaxation of the system, i.e. actuator unit 2 of stamp 1. Here it should be noted that the number of two catch posts 22 according to this version of the embodiment is not to be seen as limiting for the invention, but more than two such catch posts 22 may be provided, such as four. It is also possible to provide only one catch post 22 with the option of providing an appropriate counter bearing at support element 6 or housing 5 in place of a second catch post 22. FIG. 4 further illustrates how handle piece 24 is connected to connecting element 4 by slipping it over projections 26.

FIG. 5 shows how both openings 12 of support element 6 located in the margin areas can be opened automatically with an actuation stroke so that these openings 12 can be used for subsequent resaturation of stamp 1. For this purpose, housing 5 features projections 33 in the area of dome-like attachment 15. These projections 33 point in the direction of support element 6 and can be brought to engage with openings 12. As a result of moving support element 6 toward actuator unit 2 until it abuts against the inside of housing 5 as illustrated in FIG. 5, projections 33 protrude through openings 12, thereby pushing out sealing elements 13 at least partially. At least partially means that, in the case of foils 13*b*, remnants thereof might remain on support element 6 unless these foils 13*b* are already attached to the outside of support element 6 and removed manually before assembly of stamp 1, although it is not necessary to do so. This also means that, according to a version of the embodiment, sealing elements 13 may feature a predetermined breaking point, i.e. at least a partial narrowing of the material. This causes sealing elements 13 to break at this predetermined breaking point during assembly and only part of sealing elements 13 is pushed out into prechamber 27 of support element 6. So that sealing elements 13 may be pushed out more easily, these projections 33 may feature a cutting or punching element at the front end, i.e. in the region facing these sealing elements 13, where projections 33 may be formed with an appropriate sharp edge. Within the context of the invention there is also the option to attach these projections 33 in housing 5 so they can be rotated and connected to an appropriate operating mechanism causing the projections 33 to carry out a rotating motion and thereby a cutting motion into the sealing elements 13 during the actuation stroke.

Another option offered as part of the invention is to develop projections 33 not on housing 5 but in handle piece 24, i.e. on an interior surface 34 of handle piece 24 and also in a manner so they can be brought to engage with openings 12 or sealing elements 13. In order to do so, projections 33 feature the appropriate length. In the version according FIG. 5 of the embodiment of stamp 1, projections 33 are developed in the shape of a pipe or funnel so that these projections 33 may simultaneously serve as filler tubes, thereby simplifying the process of adding stamp ink for refilling.

It should be noted that in this version of the embodiment indicator element 28 in the form of the circumferential rib 31 simultaneously provides a contact surface for ink storage body 10. These pin-type indicator elements 28 can also come in contact with ink storage body 10. Furthermore, projections 33 may be intended to form a part of connecting element 4 and able to be brought to engage with openings 12, i.e. with sealing elements 13. In this case it is also possible to form these projections 33 as funnel or refill tubes, thereby exposing them easily by pulling handle piece 24 from connecting element 4 and as a result facilitating easy filling, i.e. refilling of stamp 1. As a general rule it is noted that projections 33 feature the form of openings 12 but are smaller than the area of openings 12 and thus can be introduced into openings 12 with ease.

Figure 6:
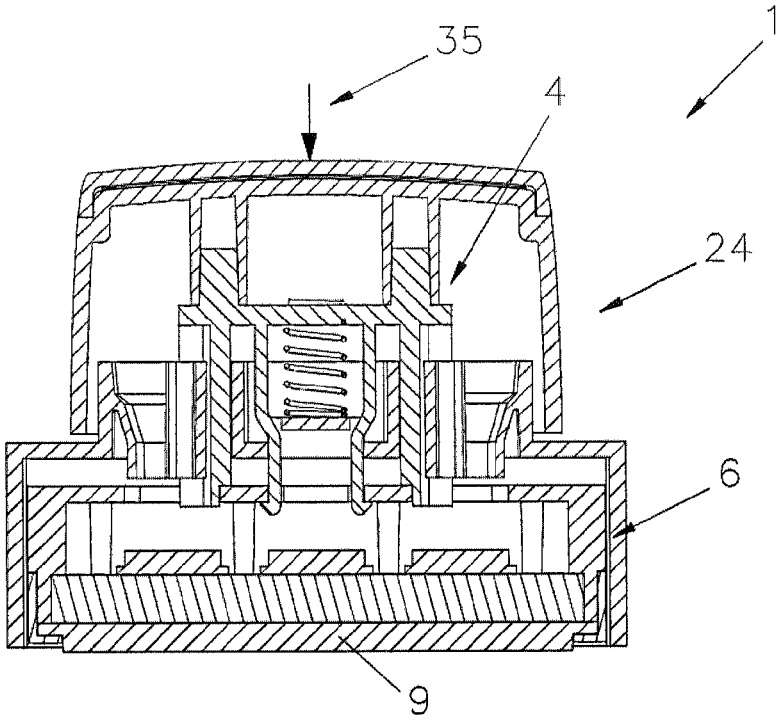
FIG. 6 Printing setting of stamp according to FIGS. 4 and 5 and with a modified version of the embodiment of the plate.

FIG. 6 depicts how stamp 1 is used to create an imprint by removing covering cap 7 (FIG. 1) and moving handle piece 24 towards the imprint area (arrow 35), thereby causing support element 6 to move toward the imprint area as well as a result of the appropriate arrangement of support element 6 on connecting element 4, as shown in FIG. 6. In the process, printing plate 9 protrudes above housing 5.

FIG. 6 shows another example of the embodiment, with printing plate 9 now not arranged in support element 6, but with printing plate 9 positioned on top of lateral walls 31*a*. This means lateral walls 31*a* are shortened and printing plate 9 is lying on top of ink storage body 10 and lateral walls 31*a* at the same time, with the latter attached by means of retaining frame 8. As a result of being mounted above retaining frame 8, printing plate 9 achieves improved sealing because the retaining frame creates the appropriate contact pressure onto lateral walls 31*a*.

Figure 7:
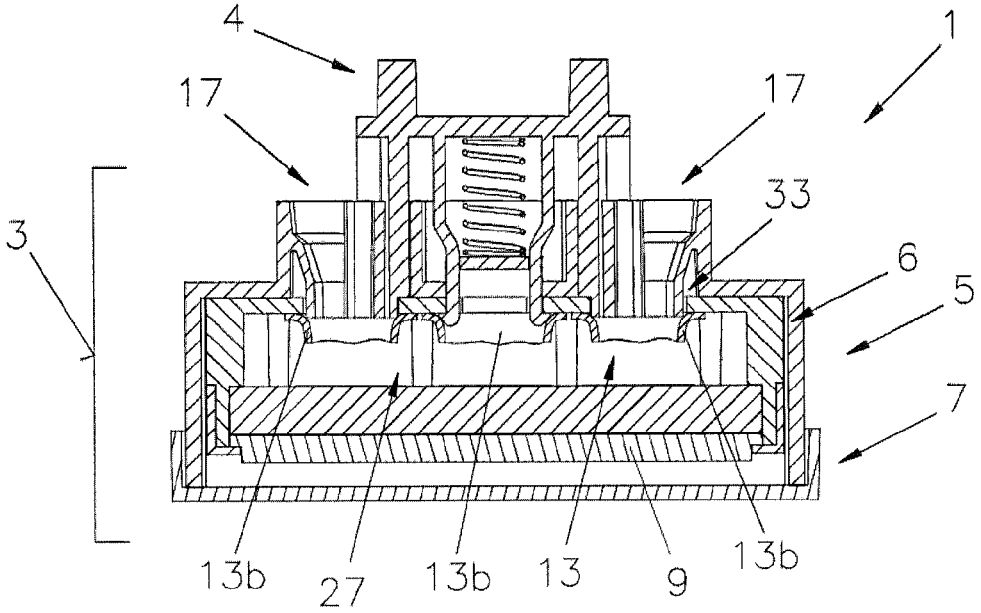
FIG. 7 Cross section of stamp according to FIGS. 4 to 6 in refilling position with pierced foil 13*b* as a sealing element.

FIG. 7 shows a first option for refilling stamp 1 with stamp ink. For this purpose, covering cap 7 is once again arranged on housing 5, printing plate 9 is in neutral setting, i.e. there is a gap between printing plate and covering cap 7. Handle piece 24 (FIG. 2) is removed and FIG. 7 depicts only printing unit 3 and connecting element 4. Removal of handle piece 24 (FIG. 2) exposes recesses 17 formed by funnel or tube-shaped projections 33. After sealing elements 13 have been pushed out by these funnel-shaped projections 33 or, in the case of foil 13*b*, pierced (as shown in schematic), prechamber 27 of support element 6 is exposed for refilling. Once again, this allows for very quick refilling because the ink is filled directly into prechamber 27, thereby starting the process of absorption by ink storage body 10, i.e. this slow process of acceptance or absorption takes place independently of the filling process. The remaining pieces of destroyed foil 13*b* do not cause any significant impairment of the processes of stamping or refilling. In the example of the embodiment depicted, foil 13*b* is attached in the interior space 27 of the support element, i.e. inside. However, since production is easier, the preferred way of arranging foil 13*b* is on the outside on pan bottom 11. Therefore, when foil 13*b* is pierced it is pushed through openings 12 into interior space 27, something that once again does not result in any restrictions. Of course, it is possible to remove foil 13*b* from openings 12 before support element 6 is installed, or the user can pierce or cut the foil manually.

Figure 8:
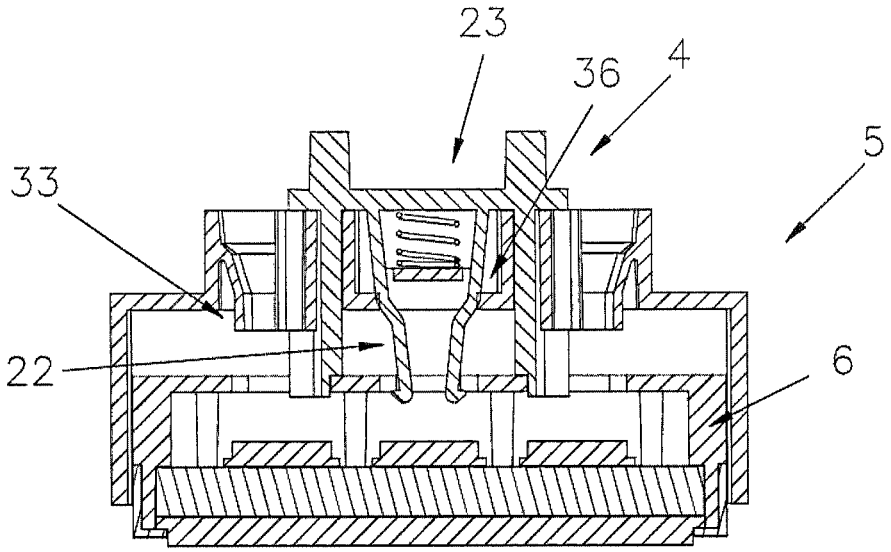
FIG. 8 Cross section of stamp in alternative refilling position.

As shown in FIG. 8, alternatively support element 6 can be uncoupled again from connecting element 4 by removing handle piece 24 (FIG. 2) and pressing connecting element 4 toward housing 5 all the way until stopped, thereby causing both catch posts 22 at connecting element 4 to move toward the center of the stamp and thus releasing the catch mechanism. For this purpose, catch posts 22 are offset or stepped along their vertical course with a slanted transitional area, wherein the gap between the two catch posts 22 in the interlocking area with support element 6 is narrower than in the area of spring 23. This compression of catch posts 22 and release from support element 6 are facilitated by the appropriate L-shaped profile elements 36 arranged on the inside of connecting element 4, with the shorter leg pointing toward the two catch posts 22. It should be noted that it is not mandatory to develop profile elements 36 with an L-shaped cross section as illustrated in FIG. 8; they can also be formed on connecting element 4 in the shape of a rib and pointing toward catch posts 22 instead.

Figure 9:
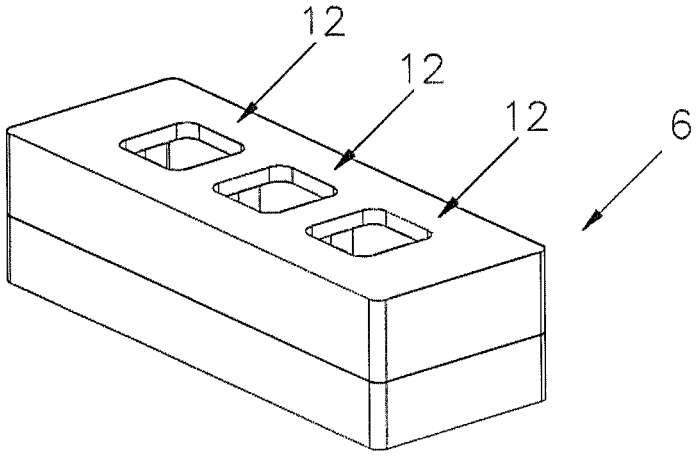
FIG. 9 Perspective of stamp's support element according to FIG. 8.

Thus support element 6 is released in its entirety as shown in FIG. 9, making openings 12 more easily accessible for refilling. Although shown in FIG. 8, in this version of the embodiment funnel-shaped formation of projections 33 may be omitted, as needed. In particular, it is not mandatory in this case to provide these projections 33 at all, since in the event of refilling any sealing element 13 (not depicted), such as foil 13*b* that might still seal off openings 12, can be peeled off shortly before refilling. Complete separation of support element 6 from connecting element 4 and therefore removal from housing 5 is advantageous in that this element might be replaced in its entirety, as the case may be, and therefore no refilling is intended.

Figure 10:
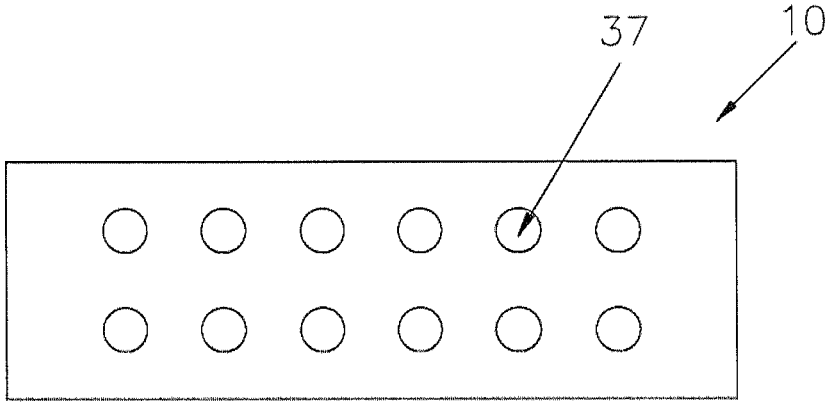
FIG. 10 Plan view of version of the embodiment of an ink storage body.
Figure 11:
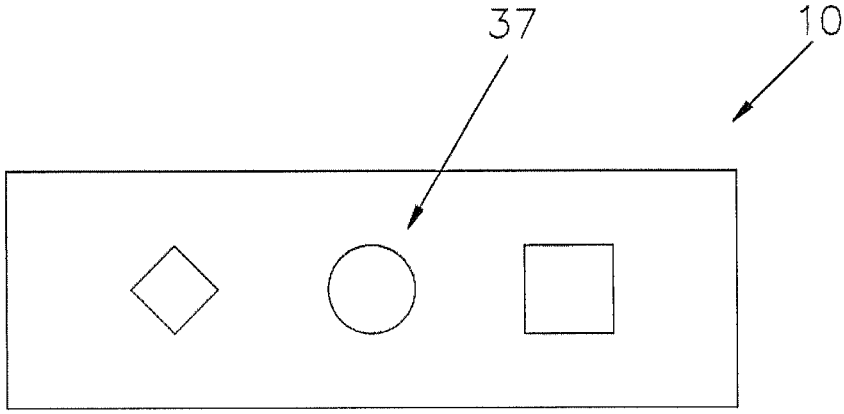
FIG. 11 Plan view of another version of the embodiment of an ink storage body.

FIGS. 10 and 11 depict different versions of ink storage body 10, each in plan view. Here, this ink storage body 10 is developed to be not only partially porous, but it also features continuous recesses 37, e.g. drilled holes, in order to accelerate the saturation time of ink storage body 10 after support element 6 (FIG. 2) has been rotated. Recesses 33 may also be provided in the form of punch-outs in ink storage body 10 and do not have to span across the entire diameter of ink storage body 10. For speedy ink absorption it is important that a great many areas are in contact with the ink. The purpose of FIGS. 10 and 11 is merely to clarify that the number of recesses 37 provided may vary and these recesses 37 may feature a variety of diameters. It is further possible for these recesses 37 to feature a cross section different from a circular cross section, such as square, elliptical, rectangular, etc. A combination of different shapes and diameters in one ink storage body 10 is possible as well.

With respect to openings 12 (FIG. 2) in support element 6 (FIG. 2) it must also be noted here that their cross sections may deviate from the one depicted, for example, it may be round, rectangular, etc. Support element 6 may also feature a cross section deviating from the cross section shown, such as one that is square, round, oval or polygonal. It is further possible for those recesses 37 not to continue all the way through the entire cross section of ink storage body 10.

FIG. 12 illustrates a version of the invention's embodiment, in particular a semi-finished product, showing only support element 6 with inserted ink storage body 10, printing plate 9 abutting against it and retaining frame 8. Here, openings 12 in pan bottom 11 of pan-shaped support element 6 are sealed liquid-tight with a common sealing element 13. For this purpose, sealing element 13 spans across prechamber 27 below openings 12 and projections 38 are provided accordingly in the area of openings 12. These projections are protruding at least partially into openings 12. This sealing element 13 may again be attached to surface of support element 6, for example, by gluing or pressing. In one version of the embodiment hereto, ribs 39 are provided in prechamber 27, with ribs arranged in sealing position at a distance from sealing element 13 and moveable so they can be brought in contact with sealing element 13 when sealing element 13 is pushed out. Here, these ribs 39 may either be part of support element 6 or these ribs 39 may also be formed as part of ink storage body 10. The purpose of these ribs 39—more than two ribs 39 may be arranged—is to push sealing element 13 from only one opening 12 during assembly of stamp 1 (FIG. 1) by way of tipping it, for instance, since sealing element 13 may feature elastomer qualities or can be developed from elastomer.

The version of the embodiment according to FIG. 13 shows a stamp 1, housing 5 of which features the dome-shaped attachment 15, but this dome-shaped attachment 15 does not feature any projections 33 as is the case with the version of the embodiment according to FIG. 5. Sealing elements 13 can be pushed out by means of appropriate arrangements, such as in or on connecting element 4 and/or on the inside of handle piece 24. Since in this version of the embodiment there is no funnel-shaped extension protruding into support element 6, it proves advantageous if another sealing element, such as a flat gasket or similar, for example, is arranged in a slot between housing and support element 6, either on the interior surface of housing 5 or on the surface of support element 6 facing housing 5, thereby preventing stamp ink from penetrating the space between support element 6 and housing 5 during the refilling process. This is not mandatory, of course, especially when appropriate elements, such as funnels or similar are used for refilling.

It should be noted here that connecting element 4 can also be integrally formed with handle piece 24, thereby rendering the version of the embodiment according to FIG. 8 particularly advantageous for refilling stamp 1.

Figure 14:
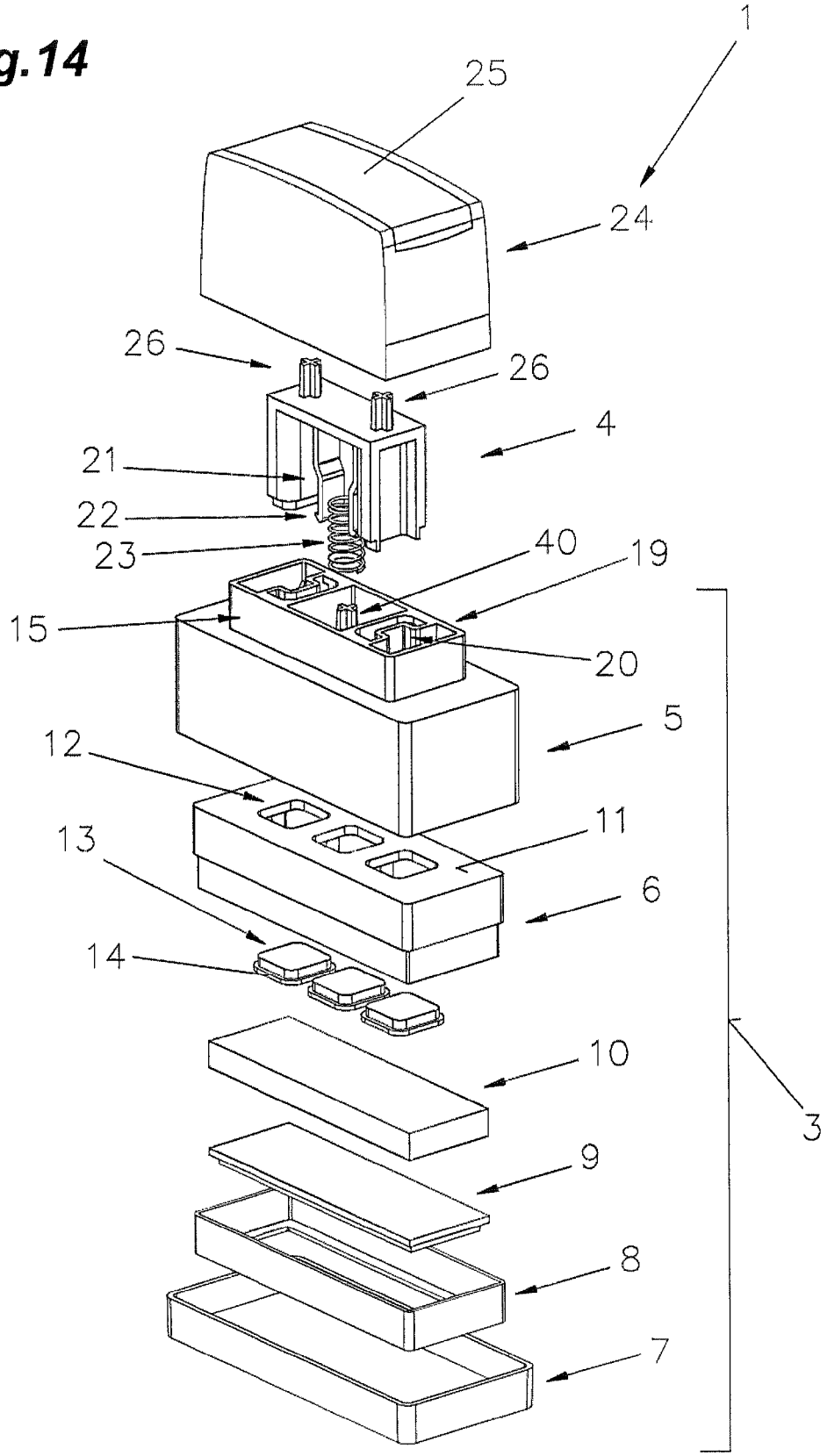
FIG. 14 Exploded view of another version the embodiment of the stamp.

FIG. 14 shows a version of the embodiment of stamp 1, with the individual components represented once again in an exploded view. This version of the embodiment in particular depicts an integrally formed sealing element 13 that can be used to seal off several openings 12 in support element 6. Unlike previous versions, housing 5 of printing unit 3 again features the dome-shaped attachment, although only recesses 16 in form of U-shaped openings or channels are arranged within dome-shaped attachment 15. On the one hand these recesses essentially featuring a U-shaped cross section serve as guiding devices 19 for the corresponding legs of connecting element 4, and on the other as refilling openings for filling stamp 1 with stamp ink again. For refilling, handle piece 24 is once again pulled off connecting element 4.

In addition, a projection 40 is visible in dome-shaped attachment 15 used to seat spring 23 of connecting element 4, thereby allowing for essentially unalterable stabilization of this spring 23 on housing 5, i.e. within dome-shaped attachment 15.

Figure 15:
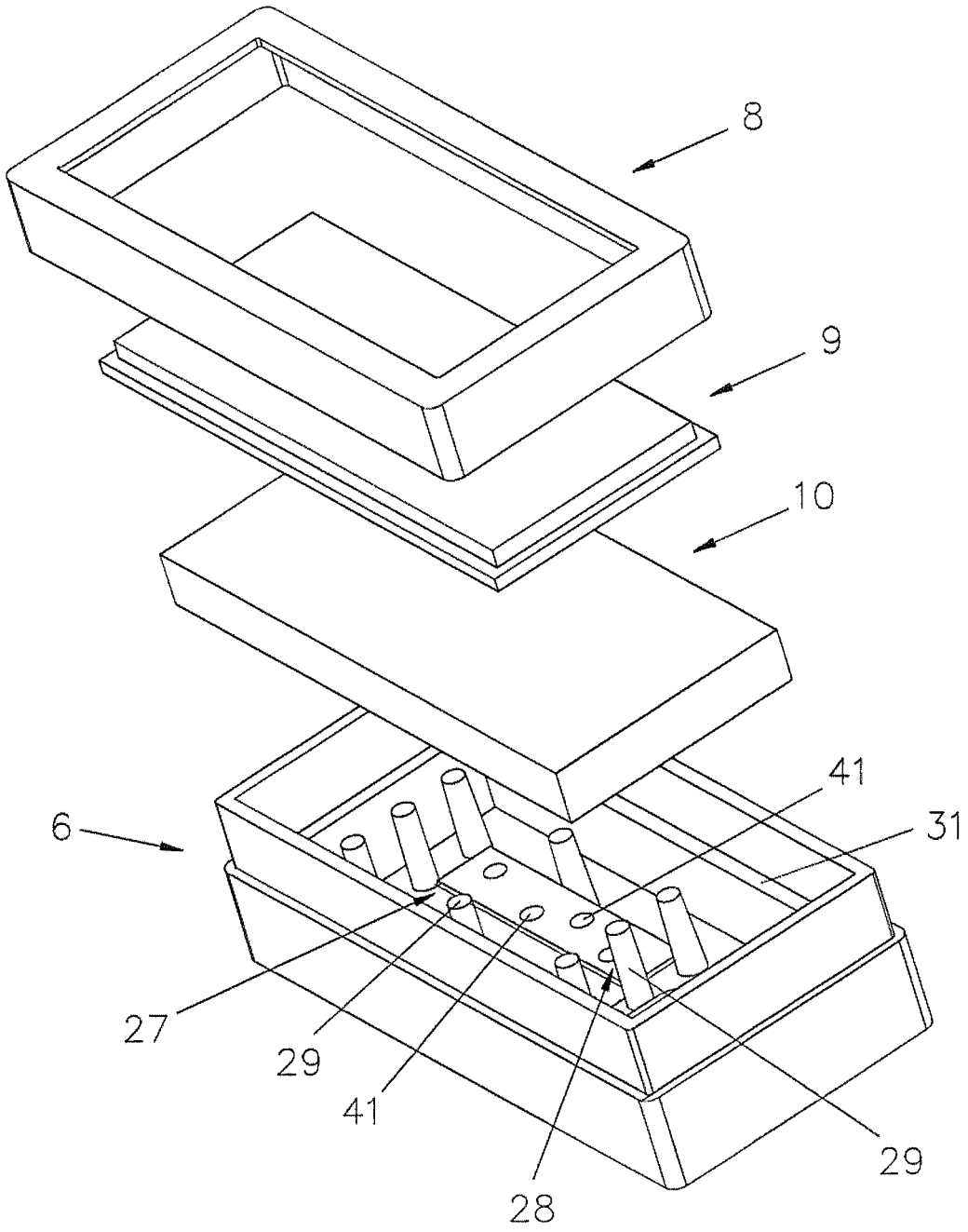
FIG. 15 Exploded view of a version of the embodiment of the support element.

Finally, FIG. 15 shows a version of the embodiment of support element 6, with pin-shaped indicator elements 28 arranged in prechamber 27. However, in deviation from the previous version of the embodiment, more of these pin-shaped indicator elements 28 are present and the area of these pin-shaped indicator elements 28 features an additional recess. The dimensions of these recesses are large enough to accommodate the integrally formed sealing element 13 for several openings 12 (FIG. 14), therefore improving saturation of ink storage body 10. Since in this version of the embodiment the dimensions of sealing element 13 are larger, it is advantageous to provide recesses 41 within this sealing element 13. According to FIG. 12, these recesses are located between projections 38. They serve to improve the flow of stamp ink into ink storage body 10 once sealing element 13 abuts against ink storage body 10 after system activation.

Although all of the above examples of the embodiment show pan bottom 11 of support element 6 with at least one opening 12, within the context of this invention it is possible to form this pan bottom 11 or support element 6 without this type of openings 12. In other words, support element 6 is fabricated to be liquid-tight as a result of the material used for production. In this case it is also possible to connect support element 6 with actuator unit 2 by means of connecting element 4, for example, by developing an indentation in pan bottom 11 featuring an undercut, where appropriate. In place of an indentation, an elevation can be provided to establish a connection with the actuator element or connecting element.

FIGS. 16 and 17 show a version of the embodiment of another semi-finished product, in particular of what is known as a stamp cartridge 42, with FIG. 16 presenting a perspective view and FIG. 17 a cross section of stamp cartridge 42. This stamp cartridge 42 can be used during initial assembly of stamp 1 or also as a refill cartridge. This means that during initial assembly of stamp 1*a* stamp cartridge 42 is mounted as support element 6. Alternatively, in case stamp 1 has already been used, a spent ink storage body 10 is removed along with support element 6 and a new stamp cartridge 42 is inserted as support element 6, including the saturated ink storage body 10 contained therein, so that an ink storage body 10 saturated with ink is available immediately. The significant aspect here is that stamp cartridge 42 is prefabricated at the plant and is then activated in stamp 1 when sold, in particular for mounting printing plate 9. The formation depicted shows the state at the time of sale for initial use and/or refilling state for stamp 1.

Basically, stamp cartridge 42 corresponds to support element 6 of the versions of FIGS. 1 to 15 described previously. In this version (not required), the only difference is extension 43 surrounding openings 12 arranged on pan bottom 11 with openings 12. This extension 43 serves to attach foil 13*b*, with a minor elevation, i.e. extension 43, facilitating an easier way to achieve liquid-tight attachment of foil 13*b*. Here, the first step in production is to manufacture support element 6 by way of an injection molding process. Subsequently, especially if there is an extension 43, foil 13*b* is attached to the outside of openings 12 by way of a thermal process. The preferred method for attaching foil 13*b* is known as "glass lidding". This "glass lidding" process is carried out according to prior art so that a detailed description is dispensed with here. "Glass lidding" is the preferred method used when maximum seal tightness is required, with preferential use of aluminum foils 13*b* or a sealing foil, glued or fused at high temperatures along the edge of the opening 12 to be sealed. Using foil 13*b* for sealing requires that foil 13*b*, in particular aluminum foil 13*b*, is coated with synthetic material heated above its melting point and then extruded directly onto foil 13*b*, in particular aluminum foil 13*b*, by means of extrusion dies. Therefore, by using the appropriate treatment, especially heating the elements, it is possible to attach foil 13*b* liquid-tight to extensions 43.

After foil 13*b* has been attached across openings 12 for the purpose of creating a seal, support element 6 is rotated as described above, the open side of pan-shaped support element 6, i.e. the open top side 11*a*, now facing upward so that ink 44 can be added without any problem and, above all, very quickly (not depicted). Once support element 6 is filled with the appropriate volume of ink 44, ink storage body 10 is inserted into pan-shaped support element 6. Since ink 44 is added so that pins 29 or rib 31 extend above the level of ink 44, further processing is possible as soon as ink storage body 10 has been inserted. This means that during or after filling there is no need to wait for ink storage body 10 to absorb at least a portion of ink 44, as is the case with prior art. Instead, further steps can be taken with support element 6 as soon as ink 44 has been added and ink storage body 10 has been inserted.

The next step is to seal the open top side 11*a* used to add ink 44 with foil 13*b* as well, with the application layer 46, in particular sealing layer, depicted at the junction points in the schematic. This means that once again foil 13*b* is attached to the circumferential edge, in particular lateral edges 31*a* of support element 6 by way of the "glass lidding" method, thereby preventing ink 44 from leaking or escaping from the interior of support element 6 after ink storage body 10 has been saturated. Once support element 6 is rotated, ink 44 can now flow onto and be absorbed by ink storage body 10 even though all sides of support element 6 are sealed with foil 13*b*. Thus, the absorption process can start immediately after this type of support element 6, in particular this type of ink cartridge 42, has been produced without the need to assemble the stamp. This means that ink 44 is absorbed by ink storage body 10 while support element 6 or stamp cartridge 42 are stored, thereby rendering additional wait times for absorption of ink 44 obsolete upon actual utilization and the stamp imprint can be generated immediately.

However, when assembling stamp 1, it is necessary to first open the area sealed by foil 13*b*, in particular the open top side 11*a*, so that filled support element 6 or stamp cartridge 42 can be used. For this purpose stamp cartridge 42 is rotated and foil 13*b* may be peeled off or cut out. Foil 13*b* may feature a pull-tab 45 that can be formed from the same material or any other material attached thereto in order to provide improved handling. Printing plate 9 is then placed onto ink storage body 10 arranged in support element 6. Retaining frame 8 is positioned for fastening to prevent printing plate 9 and ink storage body 10 from falling out of support element 6. In doing so it is possible, of course, to produce a catch connection by forming printing plate 9 and or ink storage body 10 accordingly so that retaining frame 8 can be dispensed with. Afterwards, support element 6 can be rotated again and assembly of stamp 1 can be continued according to the processes described above. Removal of foil 13*b* from openings 12 on the opposite side, i.e. from pan bottom 11 is not required because once connecting element 4 is inserted said foil is pierced or becomes pierceable, in particular by means of catch posts 22 and projections 33, no later than during the initial stamping process.

With this type of semi-finished product, in particular an ink cartridge 42, it is important that all openings 12 or open areas, in particular top side 11*a*, where ink 44 can escape, are sealed liquid-tight by means of attaching foil 13*b*, with foil 13*b* preferably attached by way of the "glass lidding" method. Using the "glass lidding" method ensures that foil 13*b* is attached liquid-tight to material of support element 6, thereby preventing ink from penetrating through foil 13*b* and leaking at the point of attachment. Thus this type of stamp cartridges 42 allows for long periods of storage and, at the same time, it can be used as initial equipment and as a refill element for stamp 1. If used as a refill element, the old support element 6 must first be removed and then stamp cartridge 42 can be installed as described above.

Thermal coated aluminum foil 13*b* is the preferred foil 13*b* used for hot sealing. For this purpose, foil 13*b*, in particular aluminum foil 13*b*, features a thickness of 30-50 μm and a directly extruded polymer coating on foil 13*b*, preferably of 20-50 μm thickness. Preferably, support element is formed using a thermoplastic container or material so that optimal liquid-tight sealing is possible. The preferred way of forming support element 6 is to divide support element 6, in particular the interior space or prechamber 27, into two areas. The first area is formed to accept ink 44 and the second area to accept ink storage body 10. This means in their filling position, both elements, in particular ink 44 and ink storage body 10, can be arranged independent of each other in support element 6, with both elements joined or placed so they can be joined to allow ink storage body 10 to accept ink 44 as a result of rotating support element 6 into stamping or storage position.

An essential advantage of stamp cartridge 42 is that it allows for significant reduction in times required to produce and use a stamp, in particular the time of assembly. The reason is that the semi-finished stamp cartridge 42 can be easily inserted by peeling foil 13*b* off top side 11*a*. Due to the filled support element 6, including the saturated ink storage body 10, the stamp cartridge can be used immediately thereafter, in particular it is ready for stamping. The other advantage is that this design allows for fully automated production of stamp cartridge 42, because no saturation periods for the absorption of ink 44 by ink storage body 10 are required. Thus, production speed is increased significantly. Since ink 44 is filled simply into support element and then supporting element 6 is sealed liquid-tight by sealing top side 11*a* with a sealing element 13, upon rotating support element 6 for storage of stamp cartridge 42, ink storage body 10 can be saturated during storage. This process is unlike prior art, with ink 44 mostly added directly to ink storage body 10, thus requiring a certain waiting period until ink 44 has been absorbed by ink storage body 10. At this point ink 44 is added again until a certain ink volume has been added to ink storage body 10. According to prior art methods, storage or installation can take place only once the complete ink volume has been added. Another significant disadvantage with prior art is that with semi-finished systems there is a risk of drying out, whereas the liquid-tight seal on support element 6 through use of the appropriate foil 13*b* prevents such drying out.

Furthermore, it must be stressed that the preferred volume of ink 44 to be added is dimensioned so as to ensure complete saturation of ink storage body 10 and sufficient additional liquid ink 44 needed for saturating printing plate 9 is left in support element 6. Thus the maximum volume of ink 44 to be absorbed is ensured as well as the ability to carry out the maximum number of stamping processes.

It is also possible to arrange fastening elements for ink storage body 10 on indicator elements 28, in particular pins 29. They can be realized by means of small hooks or simple tips onto which ink storage body 10 can be pressed. Thus, ink storage body 10 is retained in a certain position and cannot fall out, even in the event of an inadvertent rotation.

The examples of the embodiment show possible versions of the embodiment of stamp 1, a semi-finished product, a printing unit 3, and/or a stamp cartridge 42. Nevertheless, it should be noted here that the invention is not limited to the versions of the embodiment illustrated but various combinations of the individual versions of the embodiment are possible. These options for variation resulting from the technical teaching based on the concrete invention lie with the skill of the expert working in this technical field.

As a rule it is noted that this invention also comprises such examples of the embodiment of stamp cartridges and/or support elements 6 not featuring any opening 12 but a sealed pan bottom 11, with a mounting element for actuator unit 2 formed to or arranged on said pan bottom, when ink 44 is contained in/filled into the interior space, in particular pre-chamber 27, and the open top side 11*a* is sealed liquid-tight with a sealing element 13, in particular foil 13*b*. This ensures once again a very long storage period and a high degree of prefabrication. It is also possible that the saturation process is restarted during the period of storage upon insertion of an additional ink storage body 10, or, when assembling this type of stamp there is no need to consider the saturation process when the interior space is additionally divided into two areas for accepting ink 44 and ink storage body 10.

Finally, as a matter of form it should be noted that some of the representations of stamp 1 or its components are not to scale and/or are enlarged and/or reduced for the sake of improved understanding of their structure.

Moreover, individual features or their combinations from the different examples of the embodiment by themselves can represent individual and inventive solutions or solutions according to the invention even without sealing element 13, in particular separated filler tubes for stamp ink, formation of catch posts 22 and the associated removal of support element 6 from housing 5, ink storage bodies 10, or support elements 6 filled with stamp ink as a semi-finished product.

The invention claimed is:

1. An assembly for a stamp comprising: an actuator unit, a housing including a support element having a pan bottom and at least one lateral wall contiguous thereto, an ink storage body for accepting stamp ink arranged in the support element, a printing plate arranged against the ink storage body for accepting stamp ink, wherein the support element includes an opening adapted as a refill opening for stamp ink and for connecting the support element to the actuator unit, and a sealing element arranged for liquid-tight sealing of the refill opening; wherein the actuator unit includes a connecting element configured to extend into the refill opening for connecting to the support element.

2. The assembly according to claim 1, wherein the sealing element comprises a foil and is attached to the support element by "glass lidding".

3. The assembly according to claim 2, wherein the foil comprises a sealing foil.

4. The assembly according to claim 1, wherein the support element further includes a plurality of openings sealed by the sealing element.

5. The assembly according claim 1, further including ribs arranged on at least one of an interior surface of the support element or the ink storage body, with said ribs movably arranged to be brought into contact with the sealing element.

6. The assembly according to claim 1, wherein the housing comprises at least one projection facing the support element, said projection moveable so as to extend into the opening adapted as the refilling opening of the support element.

7. The assembly according to claim 6, wherein the projection comprises a cutting or punching element in an end region facing the support element.

8. The assembly according to claim 1, wherein at least one indicator element is arranged on an interior surface of the support element, said indicator element indicating at least the maximum fill height of stamp ink.

9. A stamp comprising: a printing unit and an actuator unit connected thereto by a connecting element, and a printing plate arranged in or on the printing unit, wherein said printing plate can be moved by the actuator unit from a neutral setting to a print setting against a resetting force; the printing unit comprising a housing including a support element having a pan bottom and at least one lateral wall contiguous thereto, an ink storage body for accepting stamp ink arranged in the support element, the printing plate arranged against the ink storage body for accepting stamp ink, wherein the support element includes an opening adapted as a refill opening for stamp ink, and a sealing element arranged for liquid-tight sealing of the refill opening, and wherein the actuator unit is connected to the support element by the connecting element which is configured to extend into the refill opening when the seal is disturbed.

10. The printing unit according to claim 9, wherein the actuator unit comprises at least one projection facing the support element of the printing unit, said projection moveable so as to extend into the opening.

11. The stamp according to claim 10, wherein the housing of the printing unit comprises at least one refill opening, and a guiding device for the at least one projection of the actuator unit.

12. The stamp according to claim 9, wherein the connecting element comprises at least one catch post to connect the actuator unit with the printing unit.

13. An assembly for a stamp comprising: a housing including a support element having a pan bottom and at least one lateral wall contiguous thereto, an ink storage body for accepting stamp ink arranged in the support element, and a printing plate arranged against the ink storage body for accepting stamp ink, the support element having an opening, wherein the opening serves as a refill opening for stamp ink, and a sealing element arranged for liquid-tight sealing of the opening; and a connecting element extending into the refill opening and connected to the support element, wherein the housing includes at least one projection facing the support element, said projection moveable so as to extend into the refill opening of the support element.

* * * * *